United States Patent [19]

Midgley

[11] 4,369,537

[45] Jan. 25, 1983

[54] METHOD OF FORMING A FOOTWEAR COMPONENT

[76] Inventor: Noel H. Midgley, 361 Dandenong Rd., Armadale, Victoria 3143, Australia

[21] Appl. No.: 149,289

[22] Filed: May 12, 1980

[30] Foreign Application Priority Data

May 9, 1979 [AU] Australia ..... PD8727
Dec. 19, 1979 [AU] Australia ..... PE1777

[51] Int. Cl.[3] ..... A43D 9/00; A43B 13/39; A43B 3/12; A43B 13/08

[52] U.S. Cl. ..... 12/142 RS; 12/142 S; 36/11.5; 36/14; 36/33; 36/44

[58] Field of Search ..... 36/44, 43, 14, 30 R, 36/33, 11.5; 12/142 RS, 142 T, 142 S, 146 W

[56] References Cited

U.S. PATENT DOCUMENTS

| | | | |
|---|---|---|---|
| 849,245 | 4/1907 | Johnson | 36/43 X |
| 957,394 | 5/1910 | Thoma | 36/44 X |
| 2,211,057 | 8/1940 | Duckoff | 36/43 X |
| 3,599,353 | 8/1971 | Magidson | 36/11.5 |
| 4,104,754 | 8/1978 | Almao | 36/33 |
| 4,176,476 | 12/1979 | Hassell | 36/44 |

FOREIGN PATENT DOCUMENTS

| | | | |
|---|---|---|---|
| 202612 | 7/1956 | Australia | 36/11.5 |
| 212639 | 1/1958 | Australia | 36/14 |
| 992482 | 7/1951 | France | 36/14 |
| 1068538 | 2/1954 | France | 36/14 |
| 1129727 | 9/1956 | France | 36/14 |
| 1141777 | 3/1957 | France | 36/14 |
| 1139225 | 2/1957 | France | 36/14 |
| 331758 | 11/1935 | Italy | 36/11.5 |
| 348914 | 6/1937 | Italy | 36/14 |

*Primary Examiner*—James Kee Chi
*Attorney, Agent, or Firm*—Frost & Jacobs

[57] ABSTRACT

The invention relates to a method of footwear manufacture in which a footwear component for incorporation into an article of footwear is made. The footwear component is made by simultaneously forming from a piece of sheet material a rand extending at least part-way around an innersole, the rand and innersole being substantially coplanar whereby the rand forms a substantially lateral extension of the innersole. The rand may be integral with, separable from or separated from the innersole. The sheet material may be a single layer or may be multi-layered. A footwear article incorporating the the component of the invention is also contemplated.

11 Claims, 11 Drawing Figures

METHOD OF FORMING A FOOTWEAR COMPONENT

The present invention relates to footwear and the manufacture thereof.

An article of footwear usually comprises a bottom portion and an upper. The upper may be closed as in a shoe or boot or may be open as in a sandal. The bottom portion generally includes an innersole and an outersole. It may also include a heel or wedge if the arch is raised. A footwear bottom portion may include other components or alternatively several components may be made in one piece such as by injection moulding.

Many footwear items produced by cementing the pre-formed upper to the bottom portion have a thin strip of material known as a rand which is adhered around the upper periphery of the bottom portion so as to build up the total thickness of the periphery. A rand is generally a relatively narrow strip of plastics, rubber or leather suitable for being attached around the periphery of the bottom portion. A rand may be embellished with serrations or stitching.

At the present time a rand is generally supplied in a long length which is cut and applied to the bottom portion by hand. Machines are available to apply rands to footwear items but such machine application is still very much subject to the skill of the operator. For example when soft materials such as crepe rubber are used for the bottom portion it is exceedingly difficult and in some cases impossible to lay rands with reasonable speed and accuracy by machine. In such cases it is necessary to apply the rand by hand to produce a footwear article of acceptable quality. However, such a process is labour intensive and thus relatively expensive.

Further, it has been found difficult to produce a randed outersole with inner and outer dimensions within small tolerances so that a lasted shoe upper already incorporating an innersole can be located within the cavity bounded by the rand and attached to the remainder of the bottom portion. For example if the cavity bounded by the rand is too small the lasted shoe portion will not fit within the cavity but may sit on top of the rand so that a satisfactory adhesive bond between the upper and the bottom portion cannot take place. Alternatively, if the lasted shoe portion is forced under pressure into the cavity so as to form a satisfactory bond between the upper and the bottom portion the rand is likely to be displaced laterally. When this occurs the rand no longer extends around the periphery of the bottom portion but protrudes beyond the edge of the bottom portion thus disfiguring the appearance of the assembly. The gap between the rand and periphery of the bottom portion is unsightly if it is too large.

It is an object of the present invention to provide in one embodiment a method for manufacturing a footwear component which alleviates the abovedescribed difficulties of known prior art manufacturing methods.

It is also an object of the invention to provide in another embodiment a footwear component produced by such a method and an article of footwear which includes such a footwear component.

According to the present invention there is provided a method of forming a footwear component comprising simultaneously forming from a piece of sheet material a rand and an innersole, said rand extending at least partway around said innersole, said rand and innersole being substantially coplanar whereby said rand forms a substantially planar lateral extension of said innersole.

According to various embodiments of the invention the rand may be integral with, separable from or separated from the innersole. When the rand and innersole are separated from one another during the manufacture of the footwear article it is not essential that the rand be re-associated with the particular innersole from which it was separated. However, the rand and innersole to be associated or married to one another should preferably be substantially the same size or at least complementary sizes for a satisfactory fit in the finished article.

The rand in the present and other embodiments described may be embellished as desired by colouring, embossing, stitching or other decorative means. If desired the innersole may also be dyed or embellished to make it more distinguishable from the surrounding rand.

The sheet material from which the rand and innersole are initially cut may be a single layer or a multi-layered laminate and may comprise materials known in the art to be suitable for this application including leather, leather board, leather veneer, rubber, fibre board, paper board, plastics, other composite boards or substitutes for any of the above.

The rand and innersole may initially be cut from the sheet material in substantially direct shape being the outline shape in which the rand and innersole are to be incorporated in the finished footwear article. Alternatively the rand and innersole may be cut in a larger shape sometimes called master shape from which they are subsequently trimmed or cut during manufacture to the chosen direct shape of the finished article. When the innersole is separated from the rand the inner periphery of the rand may be used to accurately locate the bottom portion in a machine to enable the outer periphery to be trimmed or cut to shape.

The type of footwear article being manufactured largely determines whether the innersole and rand are preferably integral, separable or separate. An integral arrangement may be suitably employed in the manufacture of sandals.

The invention will be described by way of example in relation to the accompanying drawings in which.

Figure 1:
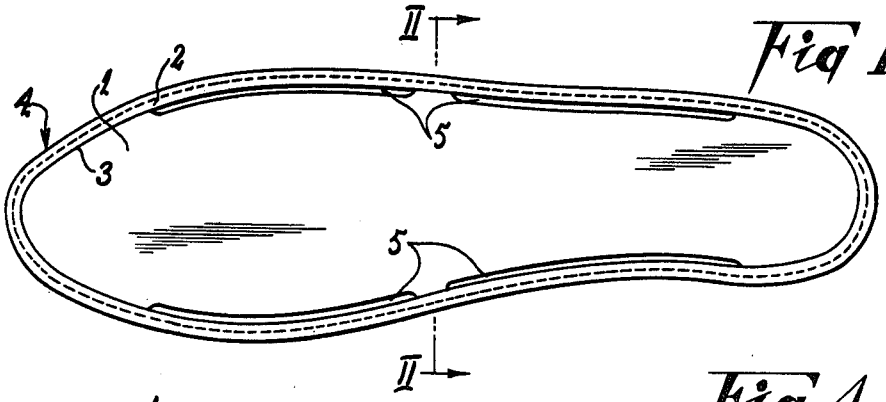
FIG. 1 is a plan view of one embodiment of the invention in which the rand and innersole are integral and slots are provided in the vicinity of the score line to receive the straps of a sandal.
Figure 2:
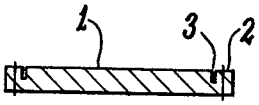
FIG. 2 is a cross-sectional view taken along line II—II of FIG. 1 and clearly shows the score line extending part-way through the single layer of the blank shown in FIG. 1.

In one preferred embodiment of an integral arrangement suitable for use in the manufacture of sandals shown in FIGS. 1 and 2, the boundary between the innersole 1 and the rand 2 is formed by a score line 3 extending part-way through the sheet material of the integral unit or blank. Preferably, the score line 3 and the outline shape 4 of the blank are formed simultaneously. This can be achieved by such known methods as using a twin bladed knife of the desired shape with the outer blade adjusted so as to cut through the material to separate the blank from the sheet of material and with the inner blade partially retracted so as to cut only part-way through the material thus forming the score line 3.

When the blank is formed in direct shape according to the present or other embodiments of the invention the score line 3 may be substantially parallel to the outer periphery 4 of the rand. The score line 3 may encircle the blank or may extend only part-way around the blank (not shown) such as for example when a rand is required only around the forepart but not around the heel or rear portion of the finished article.

Although described herein as a rand it is to be appreciated that in any embodiment where the rand is integral with the innersole or not separable therefrom, the "rand" may be considered as a mock or fake rand as it is an integral part of the innersole made to give the appearance of a separately applied strip or rand.

The blank may be used to form a completed footwear article by conventional means. For example, to form a thong-type sandal, openings (not shown) may be cut through the innersole portion of the blank. The straps may be passed through the openings and secured to the innersole to form a completed upper which includes the (mock) rand. The completed upper may be married to a bottom portion in known manner to form the finished article.

In an alternative arrangement the openings 5 may be formed in the vicinity of the score line. Preferably the openings 5 are in the form of slots extending along the score line as shown in FIG. 1. In this arrangement straps (not shown) may be passed through the slots and secured to the underside of the innersole by known means.

Either of the alternatives where openings are formed in the blank may be used with mock rand separable and separated innersole embodiments of the footwear component.

To avoid lumpiness of the innersole, packing may be provided which is preferably substantially the same thickness as the straps. Gaps may be provided in the packing to accommodate the end portion of the strap which extends through the openings of the underside of the innersole. The packing may be in the form of a skeleton or "spider" being a layer of material substantially the same shape as the innersole but with portions or gaps cut-away to accommodate the strap ends.

In the embodiments of FIGS. 3 to 6, FIGS. 7 to 9 or FIGS. 11 and 10 where the innersole is separable or separated from the rand, rather than employing a packing material, one layer of the innersole may be formed into a skeleton to accommodate the strap ends. Alternatively, a soft sheet material such as EVA or micro cell rubber may be attached to the upper surface of the bottom portion to absorb the straps instead of using a skeleton as described above.

Figure 4:
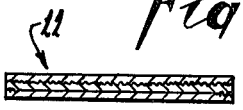
FIGS. 4, 5 and 6 are diagrammatic cross-sections through a blank of the type shown in FIG. 3 showing the stepwise formation of innersole and sole-base.
Figure 5:
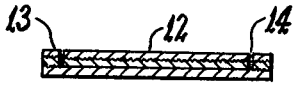
Figure 6:
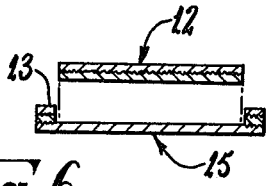
Figure 3:
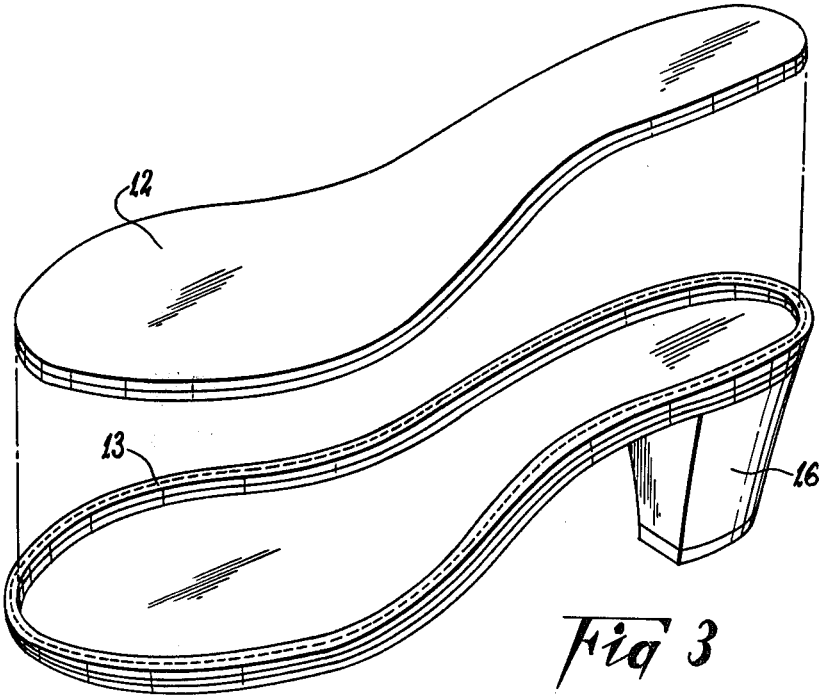
FIG. 3 is an exploded view showing another embodiment of the invention in which an innersole has been separated from a sole-base and a heel has been applied to the sole-base to complete the footwear bottom portion.

Use of a laminated sheet material 11 such as shown in FIGS. 4 to 6 is particularly suitable for another embodiment of the invention where the innersole 12 and rand 13 are separable from one another. In this embodiment the score line 14 extends through at least one of the layers of the laminated material but leaves at least one other layer substantially intact as shown in FIG. 5. This can be achieved by using a twin bladed knife having the blades arranged to cut different depths. One such arrangement of knives is described above. The blade which cuts the score line 14 may be serrated to achieve the effect shown in in FIGS. 7 to 9 of the drawings.

After cutting, one or more of the severed layers of laminate may be peeled out of the blank. The severed layer(s) which are peeled out form the innersole 12 and the remainder of the blank which includes the rand 13 may be termed the sole-base 15.

The line of separation of innersole and sole-base may be controlled partly by careful adjustment of the depth of the score line. Separation of the severed layer(s) may be achieved, for example, by not coating the area to be stripped with a full coating of adhesive or by not fully activating any adhesive applied in that area. For best results it is important to ensure satisfactory adhesion between all layers including the rand which are not intended to separate but to remain with the sole-base.

The sole-base 15 comprises at least one layer of sheet material with the rand 13 secured around the periphery of the upper surface of the sole-base 15. The lower surface of the sole base may itself form the sole of the finished footwear article. A heel 16 such as that shown in FIG. 3 may be attached thereto if a raised arch is required. If preferred, an outersole, heel, platform and/or wedge (not shown) may be affixed to the lower surface of the sole-base 15 to complete the footwear bottom portion.

Embodiments in which the lower surface of the sole-base 15 does not form the outersole are particularly advantageous as this arrangement facilitates the use of inexpensive plastics materials such as polypropylene which cannot be satisfactorily adhered to leather or other materials conventionally used for innersoles by adhesives commonly used for such applications, but which are otherwise suitable for use in footwear bottom portions, e.g. for heels, wedges, platforms or soles. It has been found that such plastics generally may be injection moulded and may be fused to the innersole material preferably during injection moulding of a footwear component.

This embodiment provides for the sole-base 15 to be inserted into an injection moulding die either before or after separation from the innersole. A plastics bottom portion or component thereof e.g. outersole, heel or wedge, may then be moulded in the die and fused or otherwise joined to the sole-base 15 preferably as part of the moulding process.

A shoe upper may be formed by conventional means (e.g. on a last) on an innersole 12 which has been peeled out from the sole-base 15. The upper may be open as in a sandal as described above or closed as in a conventional closed shoe. When a closed shoe is to be formed on the innersole 12 the outer periphery of the innersole is preferably trimmed by the thickness of the upper material to allow clearance for the completed upper to be re-married to the sole-base 15.

The upper and bottom portions may be married to form a completed shoe by using conventional adhesives.

The innersole 12 and rand 13 may be considered substantially coplanar in the completed footwear article even though in a closed article such as that provided by this embodiment the upper extends through the plane between the innersole and rand.

Figure 11:
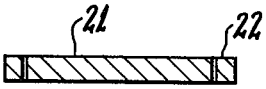
FIG. 11 is a cross-sectional view taken along lines XI—XI of FIG. 10.
Figure 10:
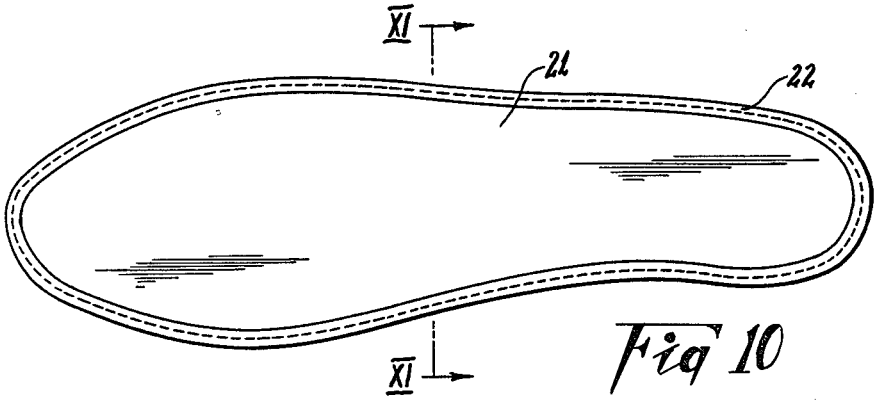
FIG. 10 is a plan view of another embodiment of footwear component according to the invention.

In another embodiment of the invention shown in FIGS. 10 and 11 the innersole 21 and rand 22 are separated from one another completely whereby a full rand is formed as an endless ring surrounding the innersole. A half rand (not shown) formed according to this embodiment is arcuate in a relaxed condition in contrast to a conventional rand which is substantially straight and needs to be bent or formed into a curve to conform to the desired configuration in the completed footwear article. The innersole 21 may be trimmed or cut as described above to allow the upper (not shown) to pass between the innersole 21 and rand 22 when the two are reassociated. This embodiment facilitates manufacture of shoes having moulded synthetic soles e.g. of rubber, crepe or plastics materials since a shaped or endless rand 22 may be conveniently located in a groove of an injection moulding die and become fused, adhered or otherwise joined to a bottom portion during moulding thereof. It is already known in the art to join a rand and bottom portion in this way. However with a conventional strip-type rand there is a join in the final product and locating the rand in the groove of the die is a relatively slow operation which must be performed by hand. Thus the cycle time of the moulding machine must be slowed to enable such feeding. On the other hand feeding of the full ring-type rand or arcuate half rand provided by the present invention is easier, more precise, quicker and may be satisfactorily automated. Thus there are considerable savings to be made by the application of this embodiment of the invention.

In embodiments where two components of the blank are separated from one another during production of an article of footwear (e.g. innersole from rand, innersole from sole-base) there are possibilities for re-associating the components with different partners from which they were originally separated. Thus for example the innersoles of a batch of yellow blanks may be exchanged for a matching sized set from blue blanks to form yellow innersoles with blue rands and vice-versa. Such colour contrast may be advantageously employed in sandals and other open-type footwear articles.

One decorative variation also suitable for use in open-type footwear articles is for the innersole to be shaped as an oval, a footprint outline or in some other decorative shape. The rand may extend from the periphery of the shaped innersole to the periphery of the bottom portion of the footwear article. In this variation therefore the rand may not appear to be a strip, but rather an edging surrounding the shaped innersole.

Another variation is to turn the innersole over and use the left innersole with the right outer component (rand, sole-base etc.). This is of particular value for example in closed shoes where a perspiration absorbing layer unsuitable for the upper surface of the rand is required to form the upper face of the innersole.

Figure 7:
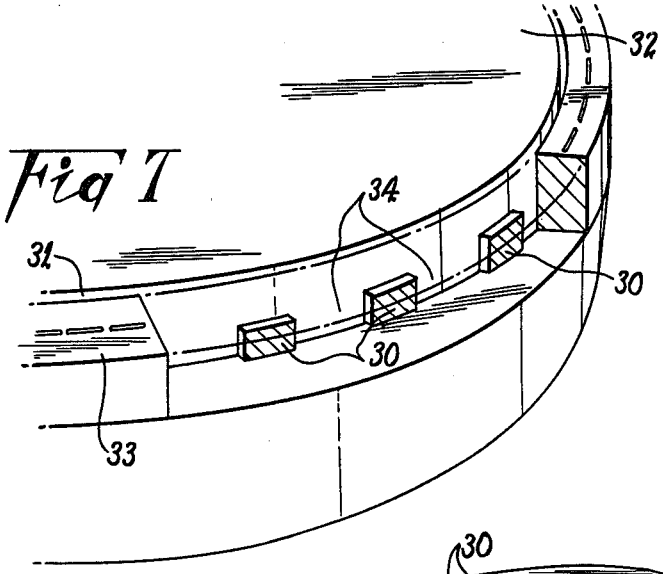
FIG. 7 is a partly broken way perspective view of a section of a rear portion of the component shown in FIG. 8.
Figure 8:
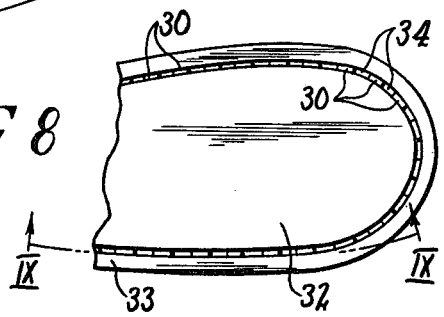
FIG. 8 is a partial plan view of the rear portion of a footwear component showing innersole, rand and score line.
Figure 9:
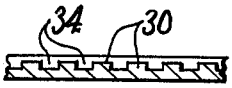
FIG. 9 is a cross-sectional view along the line IX—IX of FIG. 8.

In the embodiment where the innersole and rand are separable the score line 31 which forms the boundary between the innersole 32 and the rand 33 may comprise an alternating series of partial bridges 30 and perforations 34 as shown in FIGS. 7, 8 and 9 of the drawings. The partial bridges 30 may be formed by cutting partway through the blank so as not to completely sever the rand 33 and innersole 32 but leave small bridges 30 of sheet material connecting the rand 33 and innersole 32. The perforations 34 may be formed on the score line 31 and extend through the blank so that a lateral cross-sectional view through a blank which view cuts a perforation, shows the rand as being separated from the innersole by the perforation.

Such a score line 31 may be conveniently formed with a serrated knife. Preferably the outline shape of the blank and the score line are formed simultaneously such as by use of a twin bladed knife of the desired shape. The outer blade may be adjusted so as to cut through the sheet material to separate the blank therefrom while the inner blade may be adapted to form the score line by, for example, being serrated. The respective shapes, sizes and arrangement of bridges and perforations may be adjusted so that the innersole and rand are not prone to undesired preparation during manufacture of a footwear article although they may be separated relatively easily when desired. The separation may be achieved by stripping the innersole from the rand so as to break the bridges preferably along a line substantially parallel to the score line. The score line thus preferably serves as a line of weakness along which separation occurs.

A blank as provided by this embodiment is particularly suitable for use in the manufacture of footwear having a bottom portion, sole or wedge. To produce such an item the blank may be cut from a piece of single-layered sheet material and the socre line may be serrated so as to form an alternating series of bridges and perforations as described above. A bottom portion in master shape may be formed. The outer periphery of the blank which will subsequently form the rand may be treated with adhesive, activated if necessary and adhered to the bottom portion. Preferably the innercore of the blank is, for practical purposes, not adhered to the bottom portion. The inner core may be stripped out of the blank to form an innersole while the rand remains adhered to the bottom portion.

In another form, the blank may be mounted in a moulding die and a bottom portion may be moulded thereon. This may be done so that the blank is marginally cemented to the moulded bottom portion thus enabling the inner core to be removed from the blank whilst the rand remains adhered to the moulded bottom portion. In the former embodiment the bottom portion may be wood or any other suitable material such as leather, leather board, leather veneer, rubber, fibre board, paper board, plastics or other composite boards or substitutes for any of these.

The edges of the bottom portion may be trimmed and shaped to blend with the outer edge of the rand, or can be pre-finished if preferred. An upper, or straps for an open shoe, may be formed on the innersole as described earlier in the specification. The completed upper may be subsequently associated with the rand and the completed bottom portion by adhesion or other known means. Examples of methods of association of upper and bottom portions are given earlier in the specification.

This method of forming an open (or closed) footwear item utilising the separable embodiment described herein provides several advantages. Firstly, by associating the blank with the bottom portion before separation into rand and innersole components, the difficulties associated with accurate positioning of a strip rand around the periphery of a bottom portion are alleviated.

Thus the bottom portion may be contoured before the blank is affixed without unacceptable difficulty in applying the rand. Further, after separation the inner periphery of the affixed rand may be used for accurate location of the bottom portion on a machine for finishing the bottom portion. Such accurate location facilitates accurate finishing of the bottom portion so that the contours of the remainder of the bottom portion may blend with those of the outer edge of the rand thus providing a higher quality footwear item.

As the innersole is separated from the rand after the latter's adhesion to the bottom portion the rand automatically assumes the outline shape of the innersole even on a contoured bottom portion. Hence the reassociation of upper portion and bottom portion creates little difficulty provided the upper portion is trimmed as necessary in the manner described earlier in the specification.

In view of the time savings and superior quality facilitated by this embodiment the embodiment is considered to provide economic advantages. Further the embodiment is consistent and compatable with current footwear production techniques.

Furthermore, manufacture of footwear according to all the techniques described is consistent and compatable with current footwear production techniques and facilitates considerable cost savings and the use of materials previously having certain drawbacks.

Having now described my invention, what I claim as new and desire to secure by Letters Patent is:

1. A method of forming a footwear component comprising simultaneously forming by cutting from a single piece of sheet material a rand and an innersole, said rand extending at least part-way around said innersole, said rand and innersole being substantially co-planar whereby said rand forms a substantially planar lateral extension of said innersole, wherein the boundary between said rand and said innersole is formed by a score line extending at least part-way through the material whereby said rand may be integral with, separate or separable from said innersole in the components so formed, and wherein said boundary between said rand and said innersole formed by said score line comprises a series of partial bridges and perforations wherein the bridges are formed by cutting part-way through the material along said boundary whereby said innersole is separable from said rand.

2. A method according to claim 1 wherein said score line is formed simultaneously with cutting the footwear component from the sheet material.

3. A method according to claim 2 wherein openings are formed through the footwear component to receive portion of the upper.

4. A method according to claim 1 wherein said score line encircles said innersole and is substantially parallel to the outer periphery of said rand.

5. A method according to claim 1 wherein the footwear component is formed from laminated sheet material and wherein said score line extends through at least one of the layers of the laminated sheet material, the laminated sheet being formed so that no bond is formed between that portion of the material which forms said innersole and the remainder of the material, whereby, after formation of said score line the innersole may be separated from said rand to form a footwear component comprising a separated innersole and a sole-base portion comprising said rand secured to and extending around the periphery of the base portion, which said sole-base portion may form an outer sole of a footwear article.

6. A method according to claim 1 wherein said rand is separated from the innersole in the form of an endless ring which is positioned within a moulding die and an outer sole or wedge is fused, adhered or otherwise joined to said endless ring to form a footwear bottom portion.

7. A method according to claim 1 wherein said score line encircles said innersole and is substantially parallel to at least part of the outer periphery of said rand.

8. A method of making a footwear article wherein the rand of a footwear component formed according to claim 1 is secured to a wooden bottom portion and the innersole of the component is separated from the rand either before or after the latter is secured to the wooden bottom portion.

9. A method of making a footwear article wherein a sole base made according to claim 5 is mounted in a moulding die of a moulding machine and the sole base is attached therein to a moulded bottom portion.

10. A method of forming a footwear article having a footwear component made according to claim 6 wherein the innersole is separated from the sole base, the periphery of the innersole is trimmed by about the thickness of the material from which a shoe upper is to be made, the shoe upper is formed on the innersole and the shoe upper and the innersole are attached to the sole base.

11. A footwear article having a footwear component formed by a method comprising simultaneously forming by cutting from a single piece of sheet material a rand and an innersole, said rand extending at least part-way around said innersole, said rand and innersole being substantially co-planar whereby said rand forms a substantially planar lateral extension of said innersole and wherein the boundary between said rand and said innersole is formed by a score line extending at least part-way through the material whereby said rand may be integral with, separate or separable from said innersole in the components so formed wherein the boundary between said rand and said innersole is formed by a score line which encircles said innersole and is substantially parallel to the outer periphery of said rand and which comprises a series of partial bridges and perforations wherein the bridges are formed by cutting part-way through the material along the boundary whereby said innersole is separable from said rand, said article including a spider or skeleton in substantially the same shape as the innersole but having portions cut away to accommodate strap ends passed through the openings and underneath the innersole whereby the strap ends together with the spider provide a substantially complete layer substantially the same shape as the innersole.

* * * * *